United States Patent [19]

Balchunas

[11] 4,433,231

[45] Feb. 21, 1984

[54] ELECTRIC IRON HAVING STACKED THERMOSTAT ASSEMBLY WITH INTEGRAL OVERTEMPERATURE PROTECTION CONTROL

[75] Inventor: Charles A. Balchunas, Bethany, Conn.

[73] Assignee: General Electric Company, New York, N.Y.

[21] Appl. No.: 260,320

[22] Filed: May 4, 1981

[51] Int. Cl.[3] ..... H05B 1/02; H01H 37/76; D06F 75/26

[52] U.S. Cl. ..... 219/253; 38/82; 219/512; 219/517; 337/3; 337/35; 337/405; 337/407; 337/414

[58] Field of Search ..... 219/253, 252, 517, 512, 219/363; 337/3, 35, 401–412, 361, 299, 414; 38/82

[56] References Cited

U.S. PATENT DOCUMENTS

| | | | |
|---|---|---|---|
| 797,713 | 8/1905 | Backman . | |
| 1,309,233 | 7/1919 | Akin . | |
| 1,386,923 | 8/1921 | Capper . | |
| 2,022,531 | 11/1935 | Adams | 337/403 |
| 2,553,274 | 5/1951 | Pohl | 219/517 X |
| 2,790,049 | 4/1957 | McAlister | 337/405 |
| 2,873,347 | 2/1959 | Boggs et al. . | |
| 3,611,235 | 10/1971 | Rose | 337/35 |
| 3,665,152 | 5/1972 | Foster et al. | 219/517 X |
| 3,796,981 | 3/1974 | Poitras | 337/412 |
| 4,313,047 | 1/1982 | Cox et al. | 219/517 |
| 4,319,126 | 3/1982 | Lujic | 219/512 |

FOREIGN PATENT DOCUMENTS

| | | | |
|---|---|---|---|
| 604189 | 8/1960 | Canada | 219/253 |
| 2339674 | 2/1975 | Fed. Rep. of Germany | 219/253 |

*Primary Examiner*—A. Bartis

*Attorney, Agent, or Firm*—John F. Cullen; Leonard J. Platt; George R. Powers

[57] ABSTRACT

An electrically heated appliance, such as a steam iron, is provided with an adjustable stacked thermostat assembly having an integrated overtemperature protection control. In the case of a steam iron, the thermostat assembly is mounted on a boss on the soleplate and includes a pair of contacts carried by spring contact blades and adapted to be actuated by a heat deformable bimetallic blade to make and break the circuit to the electric heating element of the iron. The overtemperature protection control includes an electrically conductive rivet electrically connected to one of the electrical power supply terminals of the iron and a U-shaped electrically conductive spring having a first end electrically connected to a conductive member in circuit with one of the spring contact blades and a second end soldered to the rivet by a solder joint fusible at a selected overtemperature to melt and break the circuit between the rivet and the spring. The spring extends generally perpendicular to the rivet axis and parallel to and adjacent the stacked assembly with the ends of the spring surrounding the rivet and with the second end of the spring electrically insulated therefrom by a shouldered insulator. By integrating the overtemperature protection control with the stacked thermostat assembly, the overtemperature protection control responds to the same heat as the deformable blade for faster and more accurate response.

8 Claims, 3 Drawing Figures

ELECTRIC IRON HAVING STACKED THERMOSTAT ASSEMBLY WITH INTEGRAL OVERTEMPERATURE PROTECTION CONTROL

BACKGROUND OF THE INVENTION

1. Field of the Invention

The invention pertains to a specific stacked adjustable thermostat assembly used alone or preferably on an iron soleplate mount and integrally incorporates therewith an overtemperature control structure closely adjacent the thermostat as an integral part so the overtemperature control is subject to the same heat as the thermostat in a unitary assembly that uses fewer parts with faster and more accurate heat response.

2. Description of the Prior Art

Appliances, such as irons, provide a mount for a temperature controlling variably adjustable thermostat where the mount comprises a boss on the soleplate creating a heat sink or a collecting conductor for the thermostat which is mounted in close contact on the boss reacting to adjustably set temperatures. Generally, in an iron, the thermostat is mounted centrally or in the forward portion of the soleplate at the hottest part to react accordingly. It is known to use an overtemperature control in series with the thermostat to protect the iron against overheating if the thermostat malfunctions. Such an arrangement is shown in U.S. Pat. No. 3,665,152 of common assignment showing a separate overtemperature control located at the rear of the iron removed from the thermostat.

Recently developments have produced lightweight plastic irons requiring rearrangement of otherwise conventional thermostats and combining many functions in the molded plastic that eliminates many parts of previous metallic irons. Generally, a forward thermostat location is advantageous in irons which provide extra steam capacity whereby an extra slug of water is pumped into a steam boiler, usually a separate chamber, to generate an extra surge of steam which is fed into the distribution system to exit soleplate ports as extra capacity steam. Many types of surge steam irons exist and a typical one is U.S. Pat. No. 3,919,793 of common assignment. Also, the general stacked thermostat is known and used in many appliances such as irons, cookers, and other appliances where temperature is automatically set usually by a bimetal thermostat. The thermostat controls the heating element to maintain the selected temperature. For such an iron, a typical adjustable thermostat controls the heating element and is simple, inexpensive, and reliable, using fewer parts easier assembled as shown in U.S. Pat. No. 4,259,655 of common assignment. With such thermostat it is desired to provide a more efficient overtemperature control that may be used in an iron requiring fewer parts and faster and more accurate response by generally exposing the overtemperature control to the same temperature as the thermostat and integrating it as part of the thermostat.

SUMMARY OF THE INVENTION

The present invention is directed to a stacked adjustable thermostat assembly alone and in combination with an electric steam iron with a water tank, steam generating soleplate with ports, a pump connected to the tank for manual operation and a mount on the soleplate for close support of the heat-responsive thermostat assembly to control the temperature of the soleplate. In this structure, an improved stacked variably adjustable thermostat assembly includes a lower heat deformable blade, a conductive intermediate stiff spring blade, one electric terminal, a conductive upper less stiff spring blade, a separate terminal, with all the blades being supported, secured, and spaced apart on one end by interposed insulators in a sandwich-like construction with electrical contacts being provided on the conductive blades and means to transmit movement of the heat deformable blade to the upper blade to make and break an electric circuit controlling the soleplate temperature. A single structural support bracket ties all the members together in a stacked assembly. Forming part of this unitary assembly is an overtemperature control means having a T-shaped conducting rivet at the stacked assembly secured to the one terminal and a conducting compressed U-shaped spring soldered at one end to the rivet head. Insulating means is provided between the other spring end and the one terminal with the spring being electrically connected to the other separate terinal through the electrical contacts. The spring extends generally perpendicular to the rivet axis and parallel to an adjacent stacked assembly with the spring responding to the same heat as said deformable blade and being in series with said assembly for faster and more accurate heat response in the same environment as the thermostat. Thus, the main object of the invention is to disclose a unique adjustable thermostat integral overtemperature control assembly especially useful with an electric iron.

DESCRIPTION OF THE PREFERRED EMBODIMENT

The present invention is described in connection with a lightweight plastic iron as especially applicable to such use although the thermostat assembly per se has other uses than on irons. The invention represents an improved version of an adjustable thermostat assembly in U.S. Pat. No. 4,259,655 of common assignment and the iron/thermostat description is generally repeated herein. In addition, it uses the concept of an overtemperature control of U.S. Pat. No. 3,665,152 of common assignment in an improved integrated form.

Figure 1:
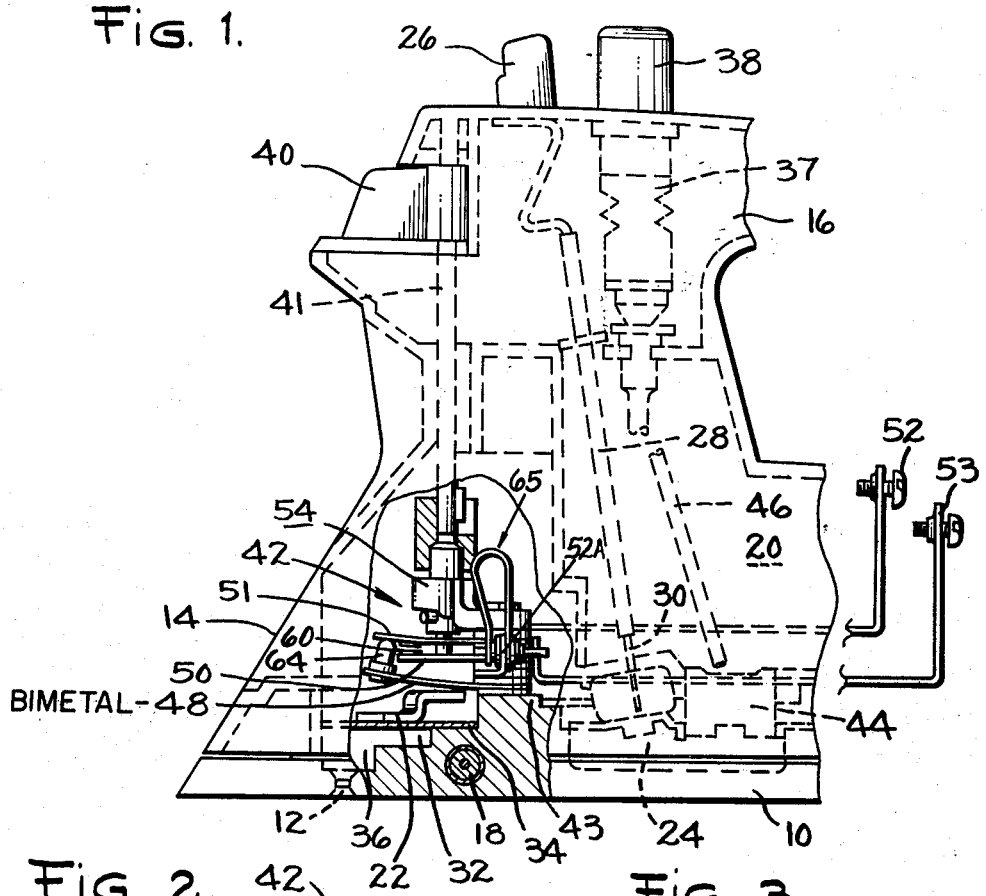
FIG. 1 is a partial elevation of a typical surge steam iron partly broken away to show the location and arrangement of the invention.

Referring to FIG. 1 there is shown an electric steam iron generally known in applicant's assignee's line of steam irons including a soleplate 10 with a plurality of steam ports 12 and an outer shell 14 connected with handle 16 in known fashion. Soleplate 10 is cast aluminum with electric heating element 18 therein for uniform heat distribution when the iron is plugged in. The iron includes means for generating steam with water tank 20 as part of a single plastic housing secured by L-shaped fastener 22. For steam, soleplate 10 has a steam generator 24 into which, under control of button 26 and guided valve stem 28 movable between an on/-off position, water drips from tank 20 onto hot soleplate 10 through metering water valve 30, the resulting steam flowing through distributing passages 32 under coverplate 34 and out ports 12 onto the fabric being ironed.

As shown, an additional surge is provided by injecting water into separate forward surge generator 36 by bellows pump 37 manually operated by separate control button 38. Variable external temperature adjustment means 40, high on the front of handle 16, connects with forward vertical control rod 41 in the handle to operate variably adjustable thermostat at 42 of the known stack type which is snugly mounted on soleplate boss 43 formed as part of the iron soleplate casting for a good heat sink contact. All of the structure thus described is conventional and fully shown in U.S. Pat. No. 4,259,655 supra.

As the iron is a self-cleaning iron of the type of U.S. Pat. No. 3,747,241 of common assignment, it has means for suddenly and completely dumping tank 20 onto the hot soleplate through a large opening that preferably, though not necessarily, is spaced and separate from the usual water valve 30. Controlling this large opening is dumper valve 44 disposed in the bottom of tank 20 and operated through rod 46 by a button, not shown, on the side of the iron to quickly empty the tank onto the soleplate where the combination of hot water and steam suddenly created purges the internal passages, tank, and soleplate ports of lint and mineral deposits.

An improved adjustable stacked thermostat assembly is provided for the iron for better heat response and is fully disclosed and claimed in said U.S. Pat. No. 4,259,655 supra. This thermostat assembly design reduces the parts normally required using a single integral bracket that performs multiple functions providing easy assembly, accurate adjustment, and a fixed locator of all structural parts. The thermostat includes a lower heat deformable or temperature responsive bimetal blade 48, a relatively stiff but flexible conductive intermediate spring blade 50 connected electrically to a connecting member 52A, and a less stiff upper spring blade 51 connected to a separate terminal 52. The three blades 48, 50, and 51 are supported and secured together at one end in a sandwich configuration along with integral support bracket 54 parallel to and above flexible blade 51. Thus, the blades, support bracket, etc. are spaced apart and electrically insulated at the one (right) end by a conventional central insulating tube not shown and interposed ceramic insulators 56 to electrically separate the parts with a suitable fastener 58 to clamp the stacked assembly together at one end for a mounting post securing the assembly snugly to soleplate boss 43.

The spring blades 50 and 51 are provided respectively with facing electrical contacts 60 which, when closed, permit current to flow through heating element 18 of the iron and when open, as shown, breaks the current flow. On the free end of bimetal blade 48 is insulator 64 such that when bimetal 48 is heated by the medium (soleplate) whose temperature it senses, it bends upwardly towards blade 51 and 64 presses against blade 51 to open contacts 60 as shown in FIG. 1 to cut off power to the iron. The support bracket 54 carries the entire stacked assembly as a unitary one-piece arrangement performing multiple functions. The structure thus far described is completely shown and claimed in U.S. Pat. No. 4,259,655 supra.

Figure 2:
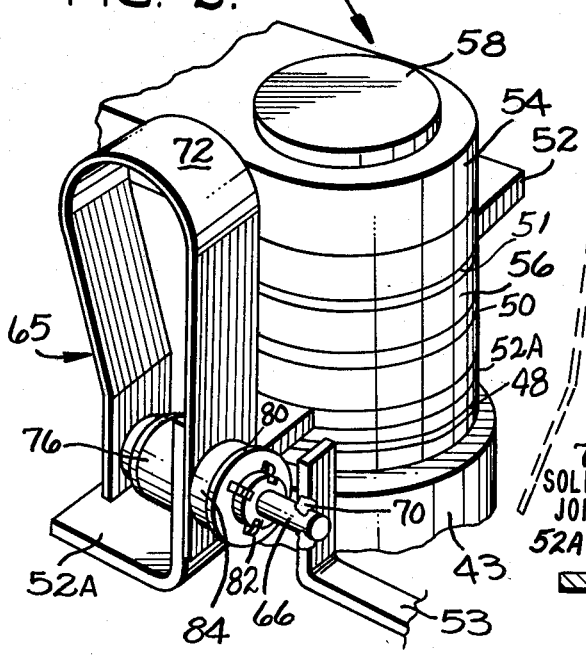
FIG. 2 is an enlarged perspective of the overtemperature control and location.
Figure 3:
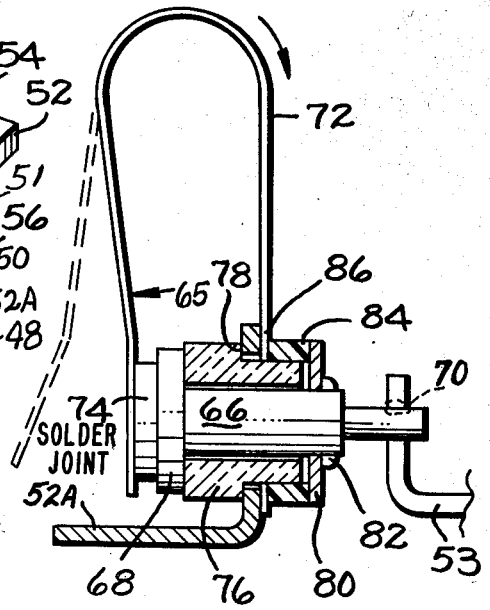
FIG. 3 is a partial sectional elevation view of the overtemperature control showing two positions.

In accordance with the invention herein shown in FIGS. 2 and 3, an overtemperature control means is provided as an integral part of the stacked assembly and subject to the same heat as the thermostat to reduce any delay in response. Essentially, the concept is to move an overtemperature control of the type of U.S. Pat. No. 3,665,152 supra forward to the hottest part of the iron and make it an integral or unitary part of the adjustable thermostat and formed for faster and more accurate response and reduce the structural complexity. To this end, the overtemperature control 65 comprises a rivet 66 having an enlarged head 68 disposed at the base of the thermostat assembly 42 as seen in FIG. 2 with the rivet with its axis generally parallel to the heat deformable blade 48 and connected to the one terminal 53 by weld 70 as shown. Thus, the electric connection is from one separate terminal 53 through weld 70 into and through the rivet 66. While soldered compressed springs opening on heat application are known, the alignment and positioning therein forms a compact package of simpler construction. For a safety release in case of overtemperature a spring that is preferably an elongated U-shaped conducting spring 72 is compressed in a perpendicular position to the rivet axis, both being closely adjacent the stack and thermostat mount 43, and held by a fusible soldered joint 74 to hold the spring compressed. Thus, the soldered joint between the rivet and spring 72 is defined as holding the rivet and spring member in electrical contact and is fusible at a predetermined overtemperature to allow the spring and rivet to separate and break the electrical connection therebetween. This is the definition and meaning of "soldered" as used in the claims. When the solder melts at a previously selected temperature in case of thermostat failure, the spring snaps into the dotted position shown breaking the circuit and shutting down the iron. Keeping the spring ends and thus connecting member 52A and terminal 53 apart is a cylindrical insulating member 76 surrounding rivet 66 and abutting the under or shank side of rivet head 68. To provide good electrical contact between the spring and rivet, the one (left) end of the spring is soldered at 74 while the other (right) end extends into and surrounds insulator 76 against a shoulder 78 in the insulator with the connecting member 52A interposed therebetween so there is good current flow from the other end of the spring at shoulder 78 through electrical contacts 60 into the connecting member 52A. In order to keep the parts together, a suitable biasing means is provided on the rivet opposite its head to press the spring against connecting member 52A at shoulder 78. This may be a ceramic or metallic washer 80 held on the rivet by a pressed-in barbed structure 82 and which washer in turn forces a spacer 84 against the bottom of the other end of the spring at 86 for a constant bias toward shoulder 78 and against member 52A. Of course, spacer 84 is a non-conducting member so the current flow is from the terminal 53 through the rivet to the soldered one end and clockwise as shown by the arrow around the spring 72 through member 52A to blade 50, contacts 60 and blade 51 of the stacked assembly to separate terminal 52. Other components may be used to insulate end 86 of spring 72 and washer 80, and spacer 84 are illustrative.

Thus, thermostat 42 and its integrated overtemperature control 65 form an essentially integrated stacked thermostat assembly with a unitary overtemperature control. The arrangement is such that using the rivet 66 at the base and parallel to the heat deformable blade 48 and then using the U-shaped spring 72 generally perpendicular to the rivet axis so that it is parallel to and adjacent the stacked assembly 42 in series with the thermostat contacts 60 to provide a compact packaged integral unit such that the spring 72 is exposed to the same heat as the deformable blade and is in the same environment and, being in electrical series connection as explained, the response is very quick with no delay in the heat sensed by the bimetal and the spring. Further, the location of the combination thermostat and overtemperature control in the forward part of the iron directly over the heating unit 18 locates the protective control 65 at the point of greatest heat generation when used in the iron of FIG. 1. By being part of the thermostat assembly, rather than the completely separate control, the device and its alignment is simplified, compact, lower cost, and easily assembled with a much faster response time.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a stacked thermostat adjustable assembly including a connecting member, a lower heat deformable blade, a conductive intermediate stiff spring blade electrically connected to said member, a first electric terminal, a conductive upper less stiff spring blade electrically connected to a second terminal, with all blades supported, secured, and spaced apart at one end by interposed insulators, and cooperable electrical contacts on said conductive blades for making an electrical circuit therebetween with means transmitting movement between the heat deformable blade to said upper blade to make and break said electric circuit and control heat to a medium sensed by said thermostat, the improvement of an overtemperature control means as part of said stacked assembly comprising, a conducting rivet at said assembly secured and electrically connected to said first electric terminal, a conducting compressed spring member soldered at one end to said rivet said solder joint being fusible to melt and break the circuit between said spring member and rivet at a selected temperature, insulating means between the other spring end and said first terminal, said other end of said spring being electrically connected to said connecting member to complete said electrical circuit from said first terminal through said rivet, spring, connecting member, blades and contacts to said second terminal, said spring extending generally perpendicular to the rivet axis and parallel to and adjacent the stacked assembly, whereby said spring responds to the same heat as said deformable blade in series with said assembly for fast heat response.

2. Apparatus as described in claim 1 wherein said spring is an elongated U-shaped conductor with said one end compressed and held by said solder to the rivet whereby the spring is an integral part of said assembly closely adjacent said stack.

3. Apparatus as described in claim 2 wherein said rivet has a head at said one end and extends parallel to said heat deformable blade, said insulating means comprises a shouldered cylindrical insulating member around said rivet between the ends thereof and abutting the rivet head, said other end of said spring and connecting member surrounding the insulating member and rivet, and means biasing the spring other end toward said shoulder and into electrical contact with said connecting member.

4. Apparatus as described in claim 3 wherein said biasing means is secured to and around said rivet opposite the head to bias the spring other end against said connecting member and in turn said connecting member against the shoulder.

5. In an electric steam iron having an enclosed water tank in a shell under connected handle structure and a steam generating soleplate with ports for distribution of steam on demand, a pump connected to the tank with a button on the handle for manual pump actuation to deliver water to the soleplate generating means and a mount on the soleplate for close support of a heat responsive thermostat and overtemperature control means in series therewith for thermostat control of the temperature of the soleplate, the improvement comprising an adjustable stacked thermostat assembly on said mount including, a lower heat deformable blade, a connecting member, a conductive intermediate stiff spring blade electrically connected to said connecting member, a first, electric terminal, a conductive upper less stiff spring blade electrically connected to a second terminal with all blades supported, secured, and spaced apart at one end by interposed insulators, and cooperative electrical contacts on said conductive blades for making an electrical circuit which remains transmitting movement between the heat deformable blade to said upper blade to make and break said electric circuit therebetween and control heat to said iron soleplate sensed by said thermostat, said overtemperature control means forming part of said stacked assembly and comprising, a conducting rivet at said assembly secured and connected to said first electric terminal, a conducting compressed spring member soldered at one end to said rivet said solder joint being fusible to melt and break the circuit between said spring member and rivet at a selected temperature, insulating means between the other spring end and said first terminal, said other end of said spring being electrically connected to said connecting member to complete said electrical circuit from said first terminal through said rivet, spring, connecting member, blades and contacts to said second terminal, said spring extending generally perpendicular to the rivet axis and parallel to and adjacent the stacked assembly, whereby said spring responds to the same heat as said deformable blade in series with said assembly for fast heat response.

6. Apparatus as described in claim 5 wherein said spring is an elongated U-shaped conductor with said one end compressed and held by said solder to the rivet whereby the spring is an integral part of said assembly closely adjacent said stack and soleplate thermostat mount.

7. Apparatus as described in claim 6 wherein said rivet has a head at said one end and extends parallel to said heat deformable blade, said insulating means comprises, a shouldered cylindrical insulating member around said rivet between the ends thereof and abutting the rivet head, said other end of said spring and connecting member surrounding the insulating member and rivet, and means biasing the spring other end against said shoulder and into electrical contact with said connecting member.

8. Apparatus as described in claim 7 wherein said biasing means is secured to and around said rivet opposite the head to bias the spring other end against said connecting member and in turn said connecting member against the shoulder.

* * * * *